US008850776B1

(12) United States Patent
Dunn

(10) Patent No.: US 8,850,776 B1
(45) Date of Patent: Oct. 7, 2014

(54) FINISHED WALL REPAIR ASSEMBLY

(71) Applicant: Jeffrey Dunn, Brea, CA (US)

(72) Inventor: Jeffrey Dunn, Brea, CA (US)

( * ) Notice: Subject to any disclaimer, the term of this patent is extended or adjusted under 35 U.S.C. 154(b) by 0 days.

(21) Appl. No.: 13/771,408

(22) Filed: Feb. 20, 2013

(51) Int. Cl.
*E04B 2/00* (2006.01)
*E04F 13/24* (2006.01)

(52) U.S. Cl.
CPC ..... *E04F 13/24* (2013.01)
USPC ..... 52/762; 52/127.2

(58) Field of Classification Search
USPC ..... 52/762, 127.2, 146, 514, 509, 202; 410/129; 248/200.1
See application file for complete search history.

(56) References Cited

U.S. PATENT DOCUMENTS 1,891,588 A * 12/1932 Claus ..... 410/151
1,951,660 A * 3/1934 Klaudt ..... 211/123
2,232,112 A * 2/1941 Hubbell et al. ..... 254/100
2,794,217 A * 6/1957 Croft ..... 248/200.1
3,027,140 A * 3/1962 Holzbach ..... 254/98
4,378,071 A * 3/1983 Yakimicki ..... 211/105.4
4,473,331 A * 9/1984 Wisecarver ..... 410/129
D318,785 S 8/1991 Dean
5,673,883 A * 10/1997 Figueroa, Jr. ..... 248/200.1
5,692,341 A 12/1997 Erlandson
5,709,054 A * 1/1998 McGillivray ..... 52/167.1
5,937,593 A * 8/1999 White ..... 52/106
6,233,877 B1 * 5/2001 Monroe ..... 52/37
6,430,883 B1 8/2002 Paz et al.
6,705,056 B2 3/2004 Tollenaar
6,910,312 B2 * 6/2005 Whitworth ..... 52/741.3
7,331,149 B2 2/2008 Tollenaar
7,614,187 B1 * 11/2009 Forbes ..... 52/202
7,731,462 B2 * 6/2010 Squyres et al. ..... 410/130
7,739,852 B2 6/2010 Brady
7,979,997 B2 * 7/2011 Pianetto ..... 33/613
8,297,011 B2 * 10/2012 Quick et al. ..... 52/202
2006/0010703 A1 * 1/2006 Gauthier ..... 33/613
2010/0058706 A1 3/2010 Trump
2010/0126113 A1 5/2010 Belanger

* cited by examiner

*Primary Examiner* — Basil Katcheves

(57) ABSTRACT

A finished wall repair assembly repairs a hole in a finished wall. The wall repair assembly includes a rod assembly. The rod assembly is configured to abut adjacently positioned wall studs wherein the rod assembly extends between the wall studs. A clip is coupled to the rod assembly. The clip is configured to abut a wall surface and a replacing surface wherein the replacing surface is securely attached in a desired position to patch a hole in the wall surface.

20 Claims, 5 Drawing Sheets

FINISHED WALL REPAIR ASSEMBLY

BACKGROUND OF THE DISCLOSURE

Field of the Disclosure

The disclosure relates to wall repair assemblies and more particularly pertains to a new wall repair assembly for repairing a hole in a finished wall.

SUMMARY OF THE DISCLOSURE

An embodiment of the disclosure meets the needs presented above by generally comprising a rod assembly. The rod assembly is configured to abut adjacently positioned wall studs wherein the rod assembly extends between the wall studs. A clip is coupled to the rod assembly. The clip is configured to abut a wall surface and a replacing surface wherein the replacing surface is securely attached in a desired position to patch a hole in the wall surface.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
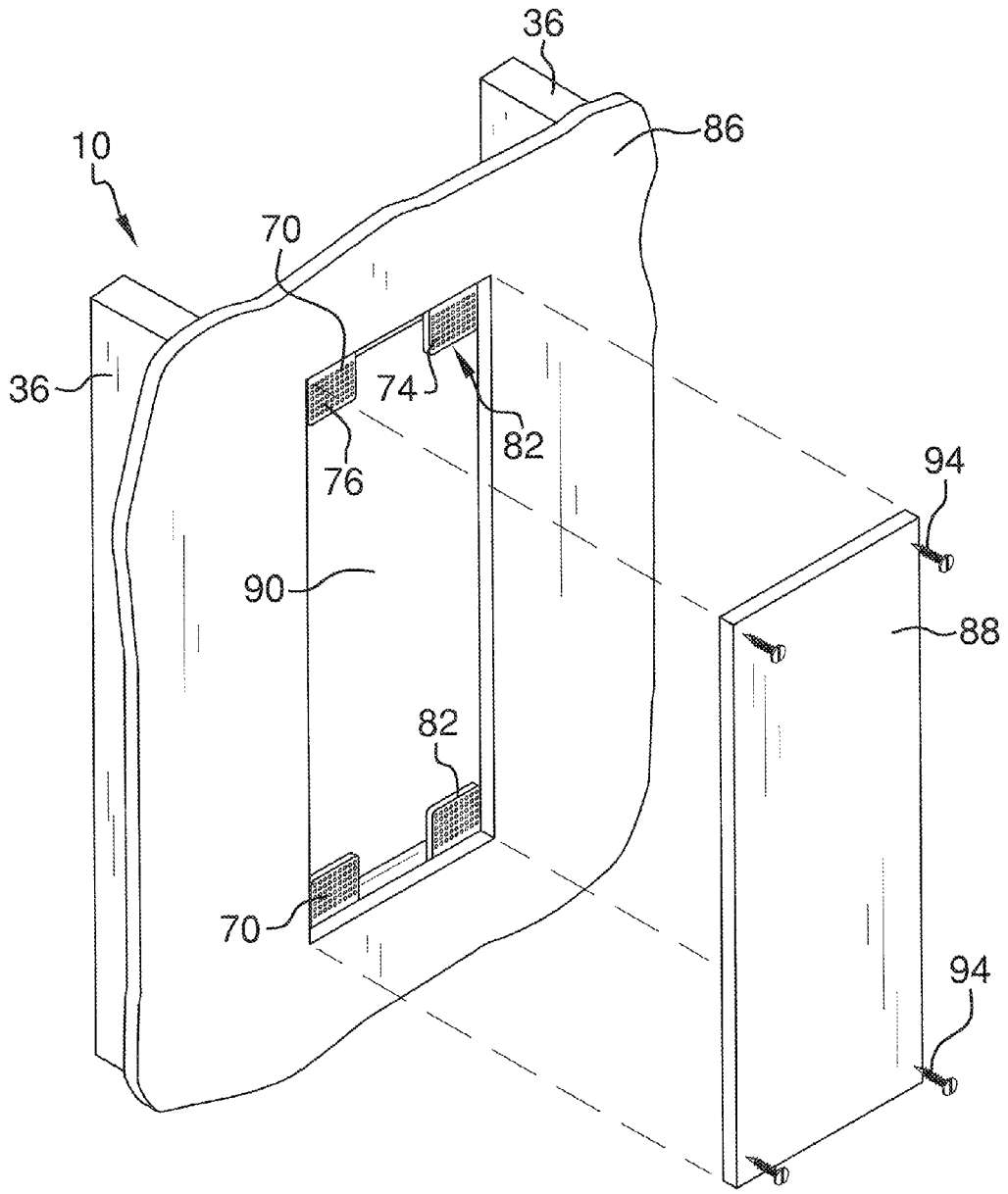
FIG. 1 is a top front side perspective view of a finished wall repair assembly according to an embodiment of the disclosure.
Figure 2:
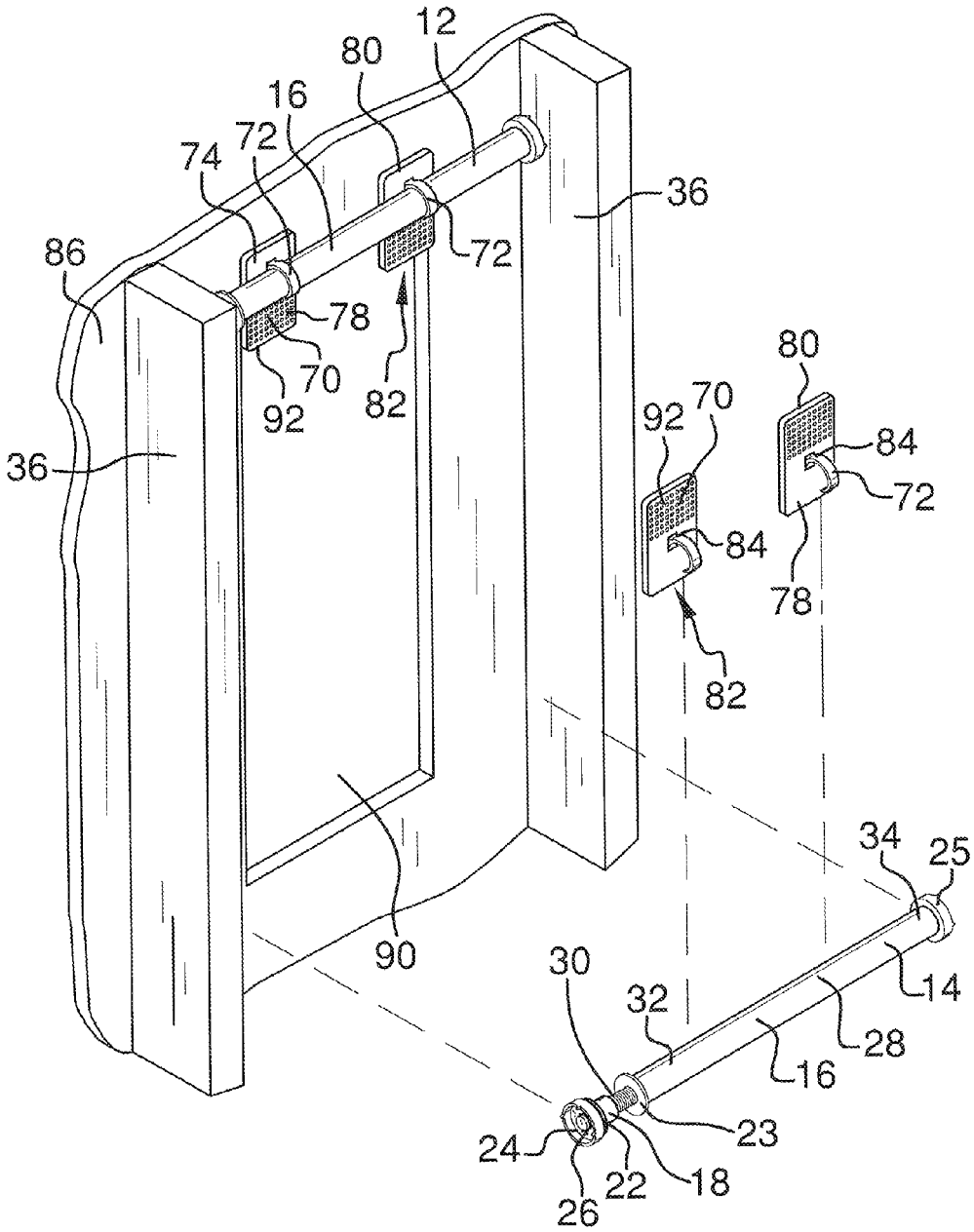
FIG. 2 is a top back side perspective view of an embodiment of the disclosure.
Figure 3:
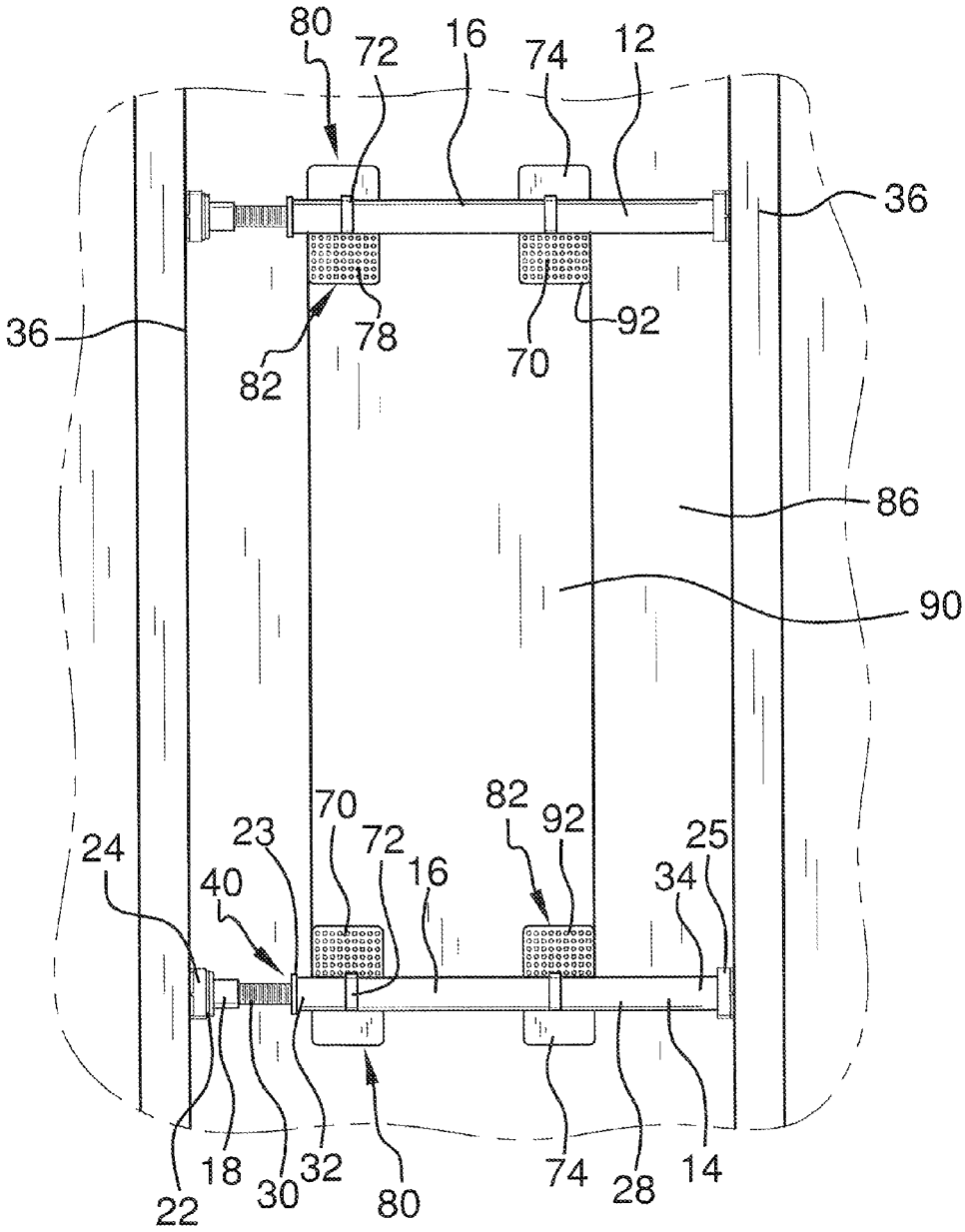
FIG. 3 is a back view of an embodiment of the disclosure.
Figure 4:
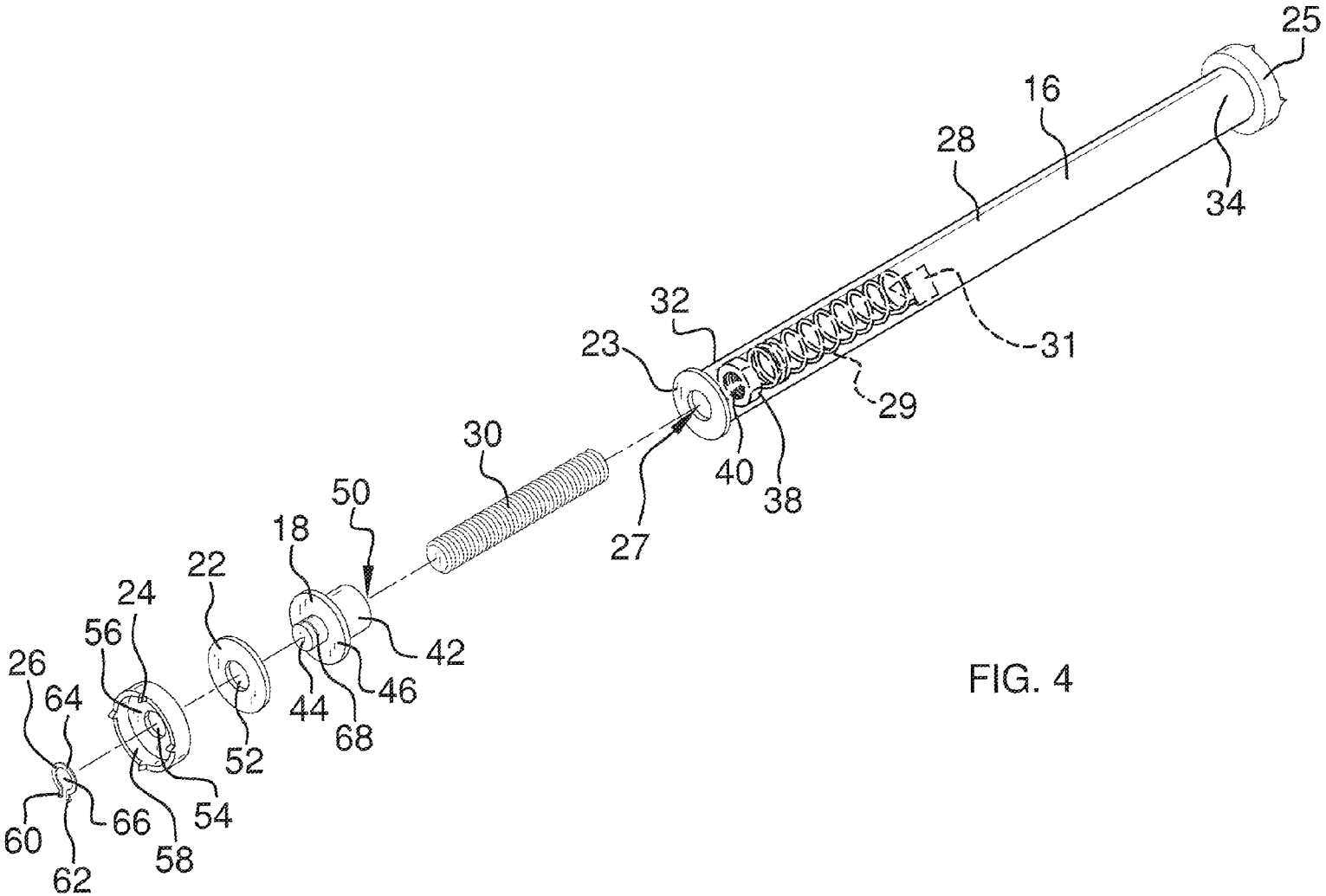
FIG. 4 is an exploded top front side perspective view of a rod assembly of an embodiment of the disclosure.
Figure 5:
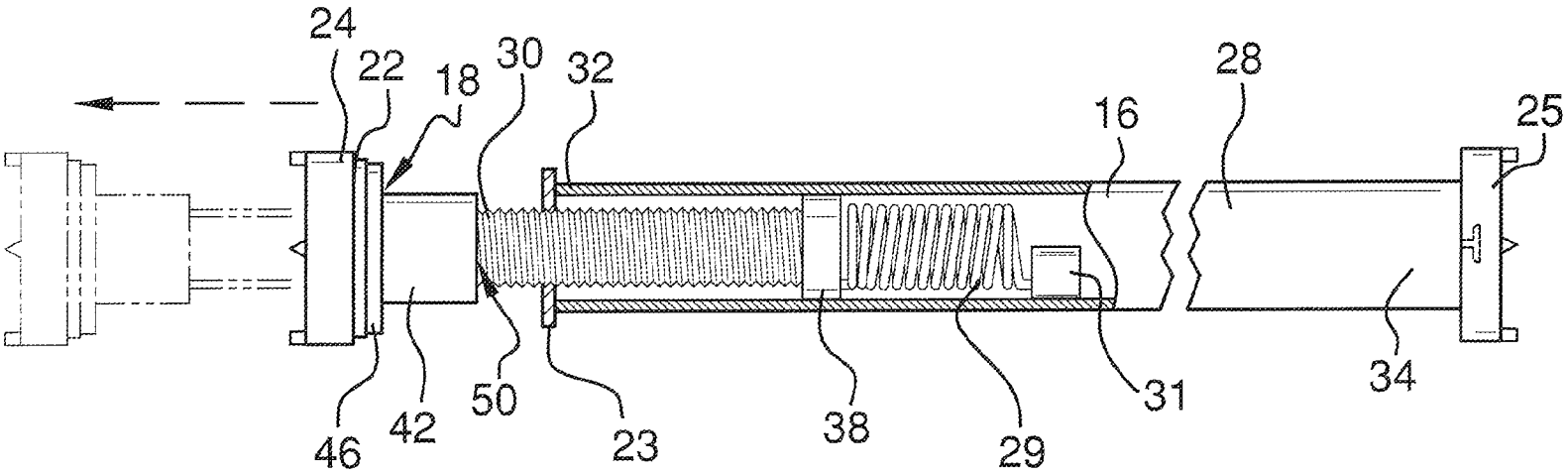
FIG. 5 is a front view of a rod assembly of an embodiment of the disclosure.

With reference now to the drawings, and in particular to FIGS. 1 through 5 thereof, a new wall repair assembly embodying the principles and concepts of an embodiment of the disclosure and generally designated by the reference numeral 10 will be described.

As best illustrated in FIGS. 1 through 5, the finished wall repair assembly 10 generally comprises a first rod assembly 12 and a second rod assembly 14. Each of the rod assemblies 12, 14 comprises a shaft 16, a support cap 18, a support ring 22, a first gripping ring 24, a second gripping ring 25, and a retaining ring 26.

The shaft 16 has a sleeve section 28 and a rod section 30. The sleeve section 28 has a first end 32 opposite a second end 34. The first end 32 and the second end 34 are open. The shaft

16 is telescopic wherein the first and second ends 32, 34 of the shaft 16 are configured to abut adjacently positioned wall studs 36 wherein the shaft 16 extends between the wall studs 36. The rod section 30 is threaded and coupled to the sleeve section 28 by a rounded, threaded nut 38 fixedly positioned inside the first end 32. The rod section 30 is preferably welded to the support cap 18, and the sleeve section 28 is preferably welded to the nut 38. The rod section 30 extends into the first end 32 of the shaft 16 and through a central aperture 40 in the nut 38. A second support ring 23 may help couple the rod section 30 to the first end 32 of the shaft 16 wherein the rod section 30 extends through an aperture 27 centrally positioned in the second support ring 23.

A biasing member 29 is coupled to the nut 38 inside the sleeve section 28 and is configured to prevent the nut 38 from rotating. The biasing member 29 can compress to a length between approximately 2 centimeters and 10 centimeters. A perforation 31 extends into the sleeve section 28 proximate the biasing member 29. The perforation 31 is positioned adjacent the biasing member 29 wherein the perforation 31 is configured to support the biasing member 29 and prevent the biasing member 29 from moving beyond the perforation 31. Each of the rod assemblies 12, 14 is positioned between the wall studs 36. The first rod assembly 12 is positioned above the second rod assembly 14. The second gripping ring 25 is rotatably coupled to the sleeve section 28 such that the second gripping ring 25 is rotated until the rod assemblies 12, 14 are securely coupled to the wall studs 36. The remainder of the shaft 16, i.e., all portions other than the second gripping ring 25, will not rotate while the second gripping ring 25 is rotated. The second gripping ring 25 is coupled to one of the wall studs 36 by conventional fasteners, which may include a nut and a bolt.

The support cap 18 has a first projection 42, a second projection 44, and a medial portion 46 coupled to and extending between the first and second projections 42, 44. The first projection 42 extends away from the second projection 44. The first projection 42 of the support cap 18 has a hollow interior 50 wherein the rod section 30 extends into and is integrally coupled to the hollow interior 50 of the first projection 42 of the support cap 18. The first projection 42 of the support cap 18 extends into and is integrally coupled to the first end 32 of the shaft 16.

The support ring 22 has a central aperture 52 and is coupled to the support cap 18. The second projection 44 of the support cap 18 extends through the aperture 52 of the support ring 22. Each of the first and second gripping rings 24, 25 has a central aperture 54, a first face 56, and a projection 58. The first gripping ring 24 is coupled to the support cap 18 and to the support ring 22 wherein the second projection 44 of the support cap 18 extends through the aperture 54 of the first gripping ring 24.

The retaining ring 26 has a first segment 60, a second segment 62, and an arcuate medial segment 64. The arcuate medial segment 64 is coupled to and extends between the first and second segments 60, 62 wherein the arcuate medial segment 64 defines an aperture 66 extending upward and outward from the first segment 60 and downward and inward toward the second segment 62. The retaining ring 26 is coupled to the first gripping ring 24 wherein the aperture 66 of the retaining ring 26 is aligned with the central aperture 54 of the first gripping ring 24. The retaining ring 26 is positioned on a groove 68 of the second projection 44 of the support cap 18 wherein the retaining ring 26 is configured for securing the support ring 22 and the first gripping ring 24 onto the support cap 18 when the retaining ring 26 is positioned in the groove 68. Both of the first and second ends 32, 34 may be telescopic wherein the sleeve section 28 is rotated and extends outward from both first and second ends 32, 34 of each of the rod assemblies 12, 14 wherein the structure of the first end 32 is identical to the structure of the second end 34.

A plurality of clips 70 is provided. Each of the clips 70 has a tab 72 coupled to a base 74. The base 74 has a front portion 76 positioned opposite a back portion 78 and a top portion 80 positioned opposite a bottom portion 82. The back portion 78 has a central aperture 84 wherein the tab 72 is removably insertable into the central aperture 84 of the back portion 78 such that the tab 72 is securely coupled to the back portion 78. Each of the clips 70 is configured to abut a wall surface 86 and a replacing surface 88 such that the replacing surface 88 is securely attached in a desired position to patch a hole 90 in the wall surface 86. Each of the bottom portions 82 of the front and back portions 76, 78 has a plurality of non-central apertures 92 wherein the non-central apertures 92 on the front portion 76 are configured to abut the replacing surface 88 when the replacing surface 88 is positioned within the hole 90 of the wall surface 86. Each of the top portions 80 of the front portions 76 of the clips 70 is configured to abut the wall surface 86. The tab 72 is positioned below the non-central apertures 92 of the clip 70 wherein the tab 72 is rounded and configured for securing around the shaft 16. The width of the clips 70 may be between approximately 2 centimeters and 8 centimeters. The height of the clips 70 may be between approximately 4 centimeters and 10 centimeters.

A plurality of screws 94 is selectively insertable into the replacing surface 88 and aligned with the non-central apertures 92 of the clips 70 wherein the screws 94 extend through the replacing surface 88 and the non-central apertures 92 of the clips 70 such that the replacing surface 88 is coupled to the clips 70. Two of the clips 70 are coupled to the first rod assembly 12 and another two of the clips 70 are coupled to the second rod assembly 14 wherein the clips 70 extend down from the wall surface 86 to behind the hole 90 in the wall surface 86 such that the replacing surface 88 covers the hole 90 in the wall surface 86 when the replacing surface 88 is coupled to the clips 70. Only a first rod assembly 12 and one clip 70 is necessary for the assembly 10 to function, although first and second rod assemblies 12, 14 and a plurality of clips 70 are contemplated.

In use, as stated above and shown in the Figures, each of the rod assemblies 12, 14 is positioned between the wall studs 36 and rotated until the rod assemblies 12, 14 are securely coupled to the wall studs 36. The first rod assembly 12 is positioned above the second rod assembly 14. The tab 72 is removably inserted into the central aperture 84 of the back portion 78 of each of the clips 70 such that the tab 72 is securely coupled to the back portion 78. Each of the tabs 72 are positioned around and coupled to the sleeve section 28 of the rod assemblies 12, 14. Each of the top portions 80 of the front portions 76 of the clips 70 is positioned to abut the wall surface 86. A plurality of screws 94 is selectively inserted into the replacing surface 88 and aligned with the non-central apertures 92 of the clips 70 wherein the screws 94 extend through the replacing surface 88 and the non-central apertures 92 of the clips 70 such that the replacing surface 88 is coupled to the clips 70. The clips 70 extend down from the wall surface 86 to behind the hole 90 in the wall surface 86 such that the replacing surface 88 covers the hole 90 in the wall surface 86 when the replacing surface 88 is coupled to the clips 70.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A finished wall repair assembly comprising:

a rod assembly, said rod assembly being configured to abut adjacently positioned wall studs wherein said rod assembly extends between the wall studs; and a clip being coupled to said rod assembly, said clip being configured to abut a wall surface and a replacing surface wherein the replacing surface is securely attached in a desired position to patch a hole in the wall surface;

said rod assembly having a shaft, said shaft having a sleeve section and a threaded rod section;

said shaft being telescopic wherein said a first end and a second end of said shaft are configured to abut adjacently positioned wall studs wherein said shaft extends between the wall studs;

said rod section being coupled to said first end of said shaft and to a support cap by a nut;

a biasing member coupled to said nut inside said sleeve section wherein said biasing member is configured to prevent said nut from rotating; and a perforation extending into said sleeve section proximate said biasing member, said perforation being positioned adjacent said biasing member wherein said perforation is configured to support said biasing member and prevent said biasing member from moving beyond said perforation.

2. The assembly of claim 1, further comprising said clip being one of a plurality of clips.

3. The assembly of claim 1, further comprising a first projection of said support cap having a hollow interior wherein said rod section extends into and is integrally coupled to said hollow interior of said first projection, a second projection of said support cap extending into and being integrally coupled to said first end of said shaft.

4. The assembly of claim 3, further comprising a support ring having a central aperture, said support ring being coupled to said support cap, said second projection of said support cap extending through said aperture of said support ring.

5. The assembly of claim 4, further comprising:

a first gripping ring;

a second gripping ring, said second gripping ring being rotatably coupled to said sleeve section;

wherein each of said gripping rings have a central aperture, a first face, and a projection; and wherein said first gripping ring is coupled to said support cap and to said support ring such that said second projection of said support cap extends through said aperture of said first gripping ring.

6. The assembly of claim 5, further comprising a retaining ring having a first segment, a second segment, and an arcuate medial segment, said arcuate medial segment being coupled to and extending between said first and second segments wherein said arcuate medial segment defines an aperture extending upward and outward from said first segment and downward and inward toward said second segment, said retaining ring being coupled to said first gripping ring wherein said aperture of said retaining ring is aligned with said central aperture of said first gripping ring.

7. The assembly of claim 6, further comprising said retaining ring being positioned on a groove of said second projection of said support cap wherein said retaining ring is configured for securing said support ring and said first gripping ring onto said support cap when said retaining ring is positioned in said groove.

8. The assembly of claim 7, further comprising said base having a top portion positioned opposite a bottom portion wherein said top portion of said front portion of said clip is configured to abut the wall surface.

9. The assembly of claim 7, further comprising said clip being removably coupled to said rod assembly.

10. The assembly of claim 9, further comprising said clip extending down from the wall surface to behind the hole in the wall surface such that the replacing surface covers the hole in the wall surface when the replacing surface is coupled to said clip.

11. The assembly of claim 1, further comprising said clip having a tab coupled to a base, said tab being rounded and configured for selectively securing around a shaft of said rod assembly.

12. The assembly of claim 11, further comprising said base having a front portion positioned opposite a back portion, said back portion having a central aperture wherein said tab is removably insertable into said central aperture of said back portion such that said tab is securely coupled to said back portion of said base.

13. The assembly of claim 12, further comprising said base having a plurality of non-central apertures positioned on said front portion and said back portion of a bottom portion of said base wherein said non-central apertures on said front portion are configured to abut the replacing surface when the replacing surface is positioned within the hole of the wall surface.

14. The assembly of claim 13, further comprising a plurality of screws being selectively insertable into the replacing surface and aligned with said non-central apertures of said clips wherein said screws extend through the replacing surface and the non-central apertures of the clips such that the replacing surface is coupled to the clips.

15. The assembly of claim 1, further comprising said rod assembly being one of a first rod assembly and a second rod assembly, said first rod assembly being positioned above said second rod assembly.

16. A finished wall repair assembly comprising:

a first and second rod assembly, each of said rod assemblies comprising a shaft having a sleeve section and a rod section, said sleeve section having a first end opposite a second end, said first end and said second end being open, said shaft being telescopic wherein said first and second ends of said shaft are configured to abut adjacently positioned wall studs wherein said shaft extends between the wall studs, said rod section being threaded and coupled to said sleeve section by a rounded, threaded nut fixedly positioned inside said first end, said rod section extending into said first end of said shaft and through a central aperture in said nut;

a biasing member coupled to said nut inside said sleeve section wherein said biasing member is configured to prevent said nut from rotating;

a perforation extending into said sleeve section proximate said biasing member, said perforation being positioned adjacent said biasing member wherein said perforation is configured to support said biasing member and prevent said biasing member from moving beyond said perforation;

a support cap having a first projection, a second projection, and a medial portion extending between and coupled to said first and second projections, said first projection extending away from said second projection, said first projection having a hollow interior wherein said rod section extends into and is integrally coupled to said hollow interior of said first projection, said second projection extending into and being integrally coupled to said first end of said shaft, a support ring having a central aperture, said support ring being coupled to said support cap, said second projection of said support cap extending through said aperture of said support ring, a first gripping ring and a second gripping ring, each of said gripping rings having a central aperture, a first face, and a projection, said first gripping ring being coupled to said support cap and to said support ring wherein said second projection of said support cap extends through said aperture of said first gripping ring, said second gripping ring being rotatably coupled to said sleeve section, and a retaining ring having a first segment, a second segment, and an arcuate medial segment, said arcuate medial segment being coupled to and extending between said first and second segments wherein said arcuate medial segment defines an aperture extending upward and outward from said first segment and downward and inward toward said second segment, said retaining ring being coupled to said first gripping ring wherein said aperture of said retaining ring is aligned with said central aperture of said first gripping ring, said retaining ring being positioned on a groove of said second projection of said support cap wherein said retaining ring is configured for securing said support ring and said first gripping ring onto said support cap when said retaining ring is positioned in said groove, each of said rod assemblies being positioned between the wall studs and rotated until said rod assemblies are securely coupled to the wall studs, said first rod assembly being positioned above said second rod assembly; and a plurality of clips, each of said clips having a tab coupled to a base, said base having a front portion positioned opposite a back portion and a top portion positioned opposite a bottom portion, said back portion having a central aperture wherein said tab is removably insertable into said central aperture of said back portion such that said tab is securely coupled to said back portion, each of said clips being configured to abut a wall surface and a replacing surface such that the replacing surface is securely attached in a desired position to patch a hole in the wall surface, each of said bottom portions of said front and back portions having a plurality of non-central apertures wherein said non-central apertures on said front portion are configured to abut the replacing surface when the replacing surface is positioned within the hole of the wall surface, each of said top portions of said front portions of said clips being configured to abut the wall surface, said tab being positioned below said non-central apertures of said clip wherein said tab is rounded and configured for securing around said shaft, a plurality of screws being selectively insertable into the replacing surface and aligned with said non-central apertures of said clips wherein said screws extend through the replacing surface and the non-central apertures of the clips such that the replacing surface is coupled to the clips, two of said clips being coupled to said first rod assembly and another two of said clips being coupled to said second rod assembly wherein said clips extend down from the wall surface to behind the hole in the wall surface such that the replacing surface covers the hole in the wall surface when the replacing surface is coupled to said clips.

17. A finished wall repair assembly comprising:

a rod assembly, said rod assembly being configured to abut adjacently positioned wall studs wherein said rod assembly extends between the wall studs; and a clip being coupled to said rod assembly, said clip being configured to abut a wall surface and a replacing surface wherein the replacing surface is securely attached in a desired position to patch a hole in the wall surface;

said clip having a tab coupled to a base, said tab being rounded and configured for selectively securing around a shaft of said rod assembly;

said base having a front portion positioned opposite a back portion, said back portion having a central aperture wherein said tab is removably insertable into said central aperture of said back portion such that said tab is securely coupled to said back portion of said base;

said base having a plurality of non-central apertures positioned on said front portion and said back portion of a bottom portion of said base wherein said non-central apertures on said front portion are configured to abut the replacing surface when the replacing surface is positioned within the hole of the wall surface.

18. The assembly of claim 17, further comprising a plurality of screws being selectively insertable into the replacing surface and aligned with said non-central apertures of said clips wherein said screws extend through the replacing surface and the non-central apertures of the clips such that the replacing surface is coupled to the clips.

19. The assembly of claim 17, further comprising said base having a top portion positioned opposite a bottom portion wherein said top portion of said front portion of said clip is configured to abut the wall surface.

20. The assembly of claim 17, further comprising said clip being removably coupled to said rod assembly.

* * * * *